US006488003B2

(12) United States Patent
Karlsson

(10) Patent No.: US 6,488,003 B2
(45) Date of Patent: Dec. 3, 2002

(54) OIL COOLER FOR INTERNAL COMBUSTION ENGINES

(75) Inventor: Jan Karlsson, Västra Frölunda (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 09/765,969

(22) Filed: Jan. 19, 2001

(65) Prior Publication Data

US 2001/0032610 A1 Oct. 25, 2001

(30) Foreign Application Priority Data

Jan. 20, 2000 (SE) ..... 0000165

(51) Int. Cl.[7] ..... F01M 1/00
(52) U.S. Cl. ..... 123/196 AB; 184/104.3
(58) Field of Search ..... 123/196 AB, 41.33; 184/104.3

(56) References Cited

U.S. PATENT DOCUMENTS 1,290,638 A * 1/1919 Morgan ..... 123/196 AB
2,844,129 A * 7/1958 Beck et al. ..... 123/41.21
5,408,965 A * 4/1995 Fulton et al. ..... 123/196 AB

FOREIGN PATENT DOCUMENTS

JP 11-21649 * 1/1999

* cited by examiner

*Primary Examiner*—Noah P. Kamen
(74) *Attorney, Agent, or Firm*—Howrey Simon Arnold & White LLP

(57) ABSTRACT

Oil cooler for cooling lubricant oil in an internal combustion engine that has a cooling element (3) that is arranged in the sump (2) of the engine and has an essentially rectangular plate with longitudinal coolant channels (4) over the major portion of its extent. The channels are joined with coolant inlet and outlet tubes (11, 16), which have connections (11*a*, 16*a*) on the outside of the sump for connection to an engine coolant system.

10 Claims, 3 Drawing Sheets

OIL COOLER FOR INTERNAL COMBUSTION ENGINES

TECHNICAL FIELD

The present invention relates to an oil cooler for cooling lubricant oil of an internal combustion engine. More specifically, the present invention pertains to an oil cooler that includes a cooling element having at least one channel with an inlet and outlet for a flowing coolant medium and that is disposed in a space containing lubricating oil.

BACKGROUND OF THE INVENTION

Oil coolers for cooling lubricating oil are available in two main types. One type has the same basic design as a conventional cooler for engine coolant; that is, it is made up of a large number of thin strips of sheet metal joined together to form channels for oil and flow-through holes for an air flow such as from a coolant fan, which can be the same fan as is used for cooling the coolant in the coolant radiator. The other type has a container through which oil flows in the engine. The container contains a battery of tubes through which coolant flows thereby cooling the surrounding oil when it flows through the container.

Common to these two types of coolers is that they are arranged outside the engine block itself and are connected to the lubricant circuit via outer conduits. Firstly, this means that the engine oil pump must be dimensioned not only for the oil volume in the engine oil ducts, but also for an oil volume outside the engine. Secondly, these oil coolers, and the conduits thereto, must be dimensioned for the maximum oil pressure of the oil system. The advantage of the latter type compared to the former type is that the coolant is heated more rapidly than the oil, and for cold starts, the oil cooler first functions as a heating element for heating the oil before it needs to be cooled.

In view of the above described deficiencies associated with known solutions for cooling oil in internal combustion engines, the present invention has been developed to alleviate these drawbacks and provide further benefits to the user. These enhancements and benefits are described in greater detail hereinbelow with respect to exemplary embodiments of the present invention.

SUMMARY OF THE INVENTION

The present invention in its several disclosed embodiments alleviates the drawbacks described above with respect to oil coolers for internal combustion engines and incorporates several additional beneficial features.

The purpose of the present invention is to achieve a simple, effective and inexpensive oil cooler of the type described by way of introduction, that requires a minimum of conduit installation, and these conduits do not need to be dimensioned for the over-pressure of the oil circulating in the engine. This means that the oil pump only needs to be dimensioned for pumping oil to the engine itself and not to an oil cooler outside the engine.

This is achieved according to the invention by virtue of the fact that the cooling element is arranged in an engine sump, and that the inlet and the outlet have connections on the outside of the sump for connection to an engine cooling system.

In a preferred embodiment of the oil cooler according to the present invention, the cooling element includes an essentially rectangular, extruded and flat aluminum profile with coolant channels over at least the major portion of its extent. End pieces are fixed to a short sides of the aluminum profile and have channels that connect the coolant channels with each other and with inlet and outlet features. The aluminum profile is also made with an oil channel open at both ends, one end of which is disposed to be connected to an inlet tube which projects down into the oil sump, and the other end of which is disposed to be connected to a suction conduit of an oil pump.

An oil cooler of this type can be manufactured at lower cost than the previously known oil coolers described above. It has low weight and requires no installation of oil conduits outside the engine itself. When changing oil, all the oil is changed, in contrast to oil changing in an engine with one of the known oil coolers, where a certain amount of old oil will unavoidably remain in the oil coolers. An additional advantage of arranging an oil cooler in the sump is that it is completely protected from corrosion, something which is definitely not the case, for example, in an air-cooled cooling element placed next to the coolant cooler of the vehicle. At the same time, an important property of the previously known oil coolers is retained; that is, the oil cooler according to the present invention also functions as a heating element for heating the engine oil when cold-started.

The beneficial effects described above apply generally to the exemplary devices, mechanisms and methods disclosed herein for the present invention. The specific structures and steps through which these benefits are delivered will be described in greater detail hereinbelow.

BRIEF DESCRIPTION OF THE DRAWINGS

The invention will now be described in greater detail in the following way, by example only, and with reference to the attached drawings, in which.

DETAILED DESCRIPTION OF THE INVENTION

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components or processes. Therefore, specific structural and functional details disclosed herein are not to be interpreted as limiting, but merely as a basis for the claims and as a representative basis for teaching one skilled in the art to variously employ the present invention.

Figure 1:
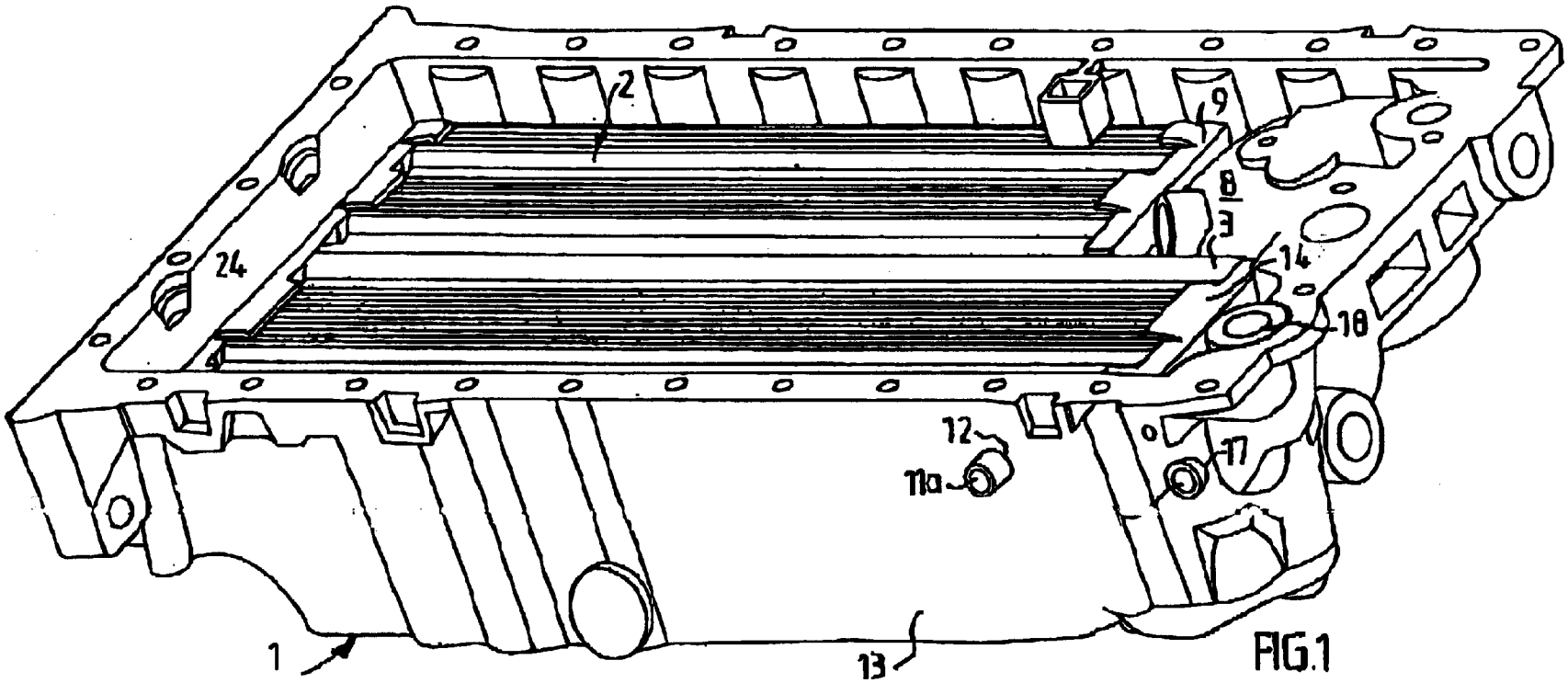
FIG. 1 shows a perspective view of a sump in an internal combustion engine with one embodiment of an oil cooler according to the invention.

FIG. 1 designates a sump 1, which is intended to be screwed securely to the underside of the crankcase of a cylinder block (not shown) of an internal combustion engine. In the sump 1, an oil cooler configured according to the invention, and generally designated by the reference numeral 2, is fixed therein by suitable arrangement.

Figure 2:
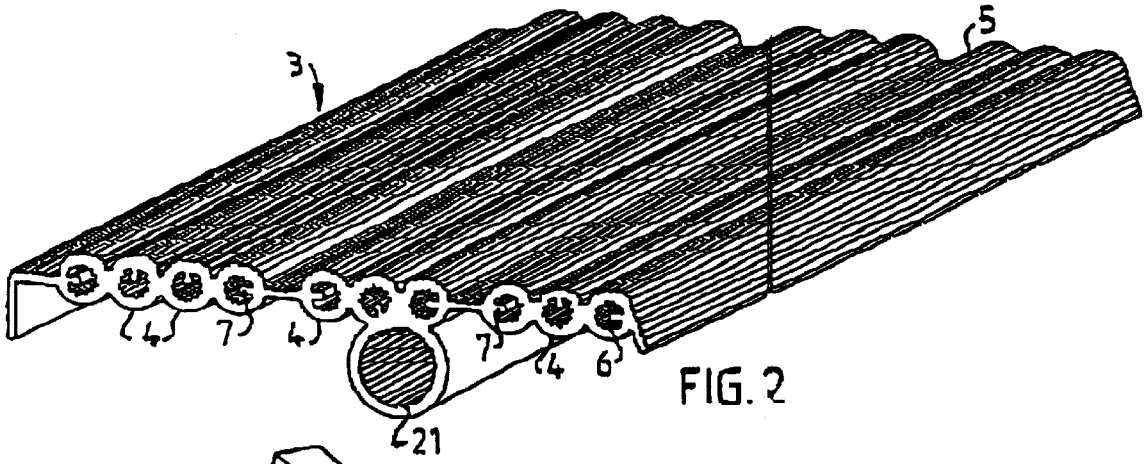
FIG. 2 shows a perspective view of an embodiment of a cooler element for the oil cooler according to FIG. 1.
Figure 3:
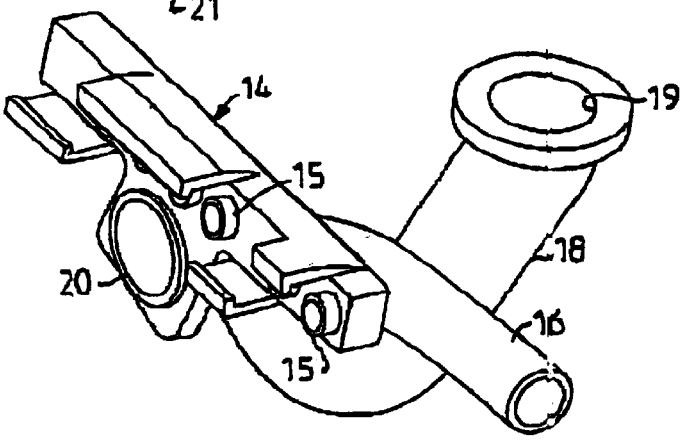
FIG. 3 shows a perspective view of one embodiment of an end piece for the cooler element from FIG. 2.

The oil cooler 2 comprises a cooler element 3 that is depicted in FIG. 2 as an essentially rectangular extruded aluminum profile made with ten parallel, longitudinal channels 4 that extend over the entire length of the cooler element's 3 profile and over most of its breadth. The channels 4 have corrugated external walls 5 and corrugated internal walls 6. Furthermore, a longitudinal rib 7 extends through each channel 4 along its entire length. In this manner, by way of a large heat transfer surface, an effective heat transfer between the coolant flowing through the channels 4 and the oil on the outside of the cooling element is achieved.

Figure 4:
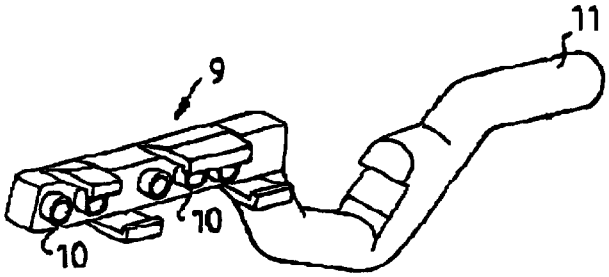
FIG. 4 shows a perspective view of one embodiment of a second embodiment for end piece for the cooler element from FIG. 2.
Figure 5:
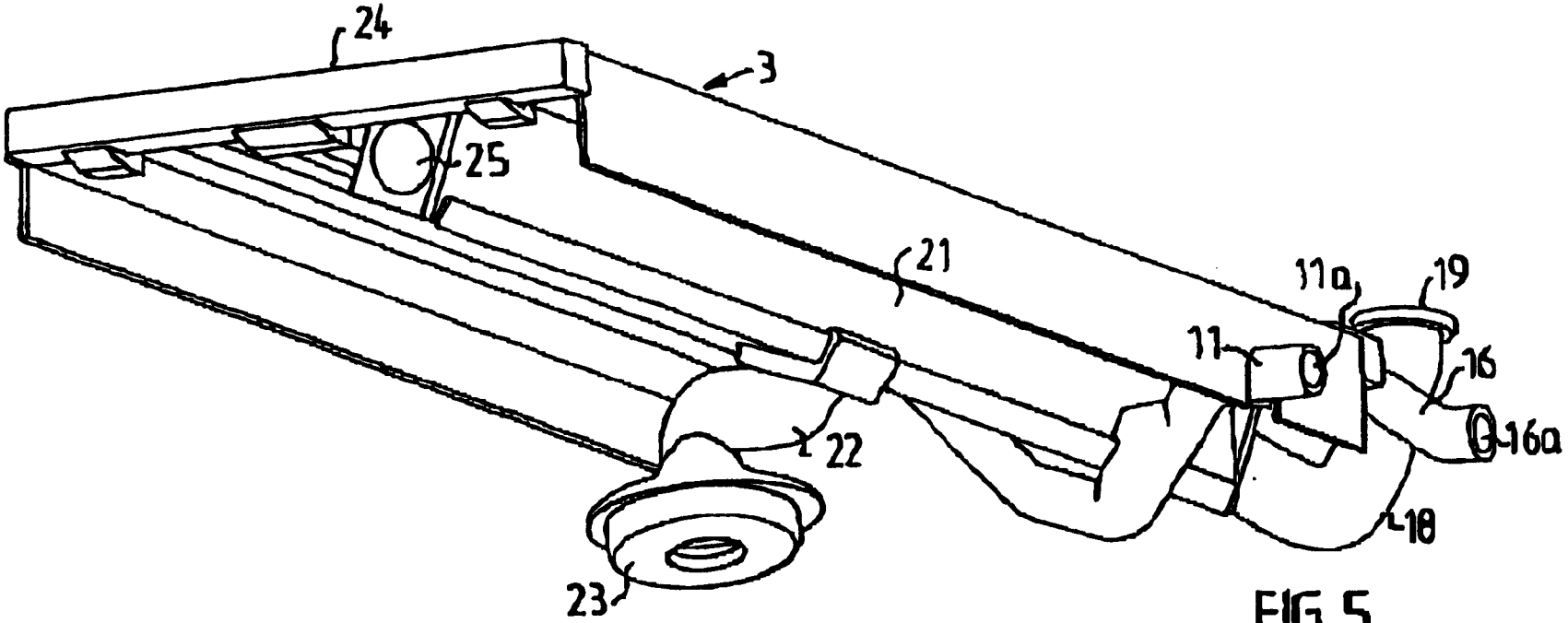
FIG. 5 shows an assembled perspective view of the components depicted in FIGS. 2–4.

In the exemplary embodiment shown in FIGS. 1 and 5, the oil cooler 2 is made to fit in the sump 1, which at one short side has a housing 8. The cooling element 3 is thus made with shorter channels in the area in front of the housing 8. An end piece 9, which is shown in greater detail in FIG. 4, is fixed to the ends, facing the housing 8 of the shorter channels 4. The end piece 9 is a unit advantageously cast in one piece, preferably of aluminum, and having pipe stubs 10, which project into the channel ends and join them to a channel (not shown) that runs inside the end piece 9 and which runs into an outlet or inlet tube 11 for coolant. The tube 11 extends through a sealed opening 12 in the side wall 13 of the sump. The outer tube end 11*a* of the tube 11 is intended to be connected to a coolant hose running either to or from the vehicle radiator, depending on whether the tube is an outlet or inlet tube.

The longer channels 4 of the cooling element 3 to one side of the housing 8 are connected, on their corresponding short side, to an end piece 14 which, like the end piece 9, is a unit advantageously cast in one piece, preferably in aluminum, which has pipe stubs 15, which extend into the channel ends and join them to a channel (not shown) inside the end piece 14, said channel in turn opening into an inlet or outlet tube 16 for coolant. The tube 16 extends through a sealed opening 17 in the side wall 13 of the sump. The external end 16*a* of the tube 16 is intended to be connected to a coolant hose from or to the vehicle radiator, depending on whether the tube is an inlet or outlet tube. The end piece 14 is also made with an oil tube 18 having an end 19 intended to be connected to an oil pump inlet (not shown) and an end 20, which projects into an oil channel 21 made in one piece with the cooling element 3.

Approximately midway between its ends, the oil channel 21 has an inlet opening (not shown), to which an oil suction tube 22, with an oil strainer 23, is connected.

At the opposite end of the cooling element, there is an end piece 24 with corresponding tube stubs, which has an interior channel joining the ends of the channels 4 each other. The end piece 24 is also provided with a plug 25 that seals the end of the oil channel 21. During operation, oil is drawn through the suction tube 22, the channel 21 and the oil tube 18 of the end piece 14 to the engine oil pump. At the same time, the coolant pump of the engine pumps coolant through the channels 4 of the cooling element 3 via the inlet and outlet tubes 11 and 16, respectively.

The cooling element 3 is fixed in such a manner above the oil level in the sump that the entire cooling element at normal oil level lies above the surface of the oil, and the crank throws of the engine crankshaft sweep immediately above the upper surface of the cooling element so that oil thrown out by the crank throw strikes the cooling element. In order to make sure that oil will run off the upper surface of the cooling element in a non-inclined engine, the cooling element can be fixed in a somewhat inclined orientation relative to the upper plane of the sump 1, in principle a horizontal plane. The cooling element 3 can slope somewhat in the longitudinal direction, in the transverse direction or in both of these directions. If the engine itself is inclined in the engine room, the cooling element is preferably fixed perpendicular to the cylinder axis.

The placement of the cooling element in the manner described above also means that the cooling element functions as a splash shield. Instead of a cast cooling element with parallel channels, other types of heat exchangers can be used such as plate heat exchangers.

What is claimed and desired to be secured by Letters Patent is as follows:

1. An oil cooling arrangement in an internal combustion engine, the arrangement comprising:

an internal combustion engine having a sump into which circulating lubricant is collected;

a cooling element adapted to flow coolant through an interior space therein, the cooling element being disposed in the sump and arranged for contact with lubricant contained therein;

the cooling element further comprising an inlet and an outlet, the inlet and the outlet being fluidly connected to a cooling system of the internal combustion engine for circulating engine coolant through the cooling element, thereby cooling heated oil collected in the sump;

wherein the cooling element is formed as a substantially rectangular, extruded and flat aluminum profile, the cooling element comprising one or more coolant channels arranged over at least a majority thereof;

the cooling element further comprising end pieces fixedly attached to the short sides of the profile and having channels for connecting the one or more coolant channels with each other and with the inlet and the outlet; and the profile further comprising an oil channel open at both ends, wherein one end is joined to a suction tube extending downwardly into the sump, and wherein another end is arranged to be connected to a suction conduit to an oil pump.

2. The arrangement as recited in claim 1, wherein said arrangement is further adapted to heat cool lubricant in said sump during start-up time periods of said internal combustion engine.

3. The arrangement as recited in claim 1, further comprising:

said cooling element being substantially flat-shaped and having a plurality of longitudinal channels, said longitudinal channels each being in fluid communication with each other and with said inlet and said outlet.

4. The arrangement as recited in claim 1, wherein said cooling element is elongate and has a plurality of parallel channels extending in a longitudinal direction of said cooling element.

5. The arrangement as recited in claim 1, wherein said cooling element is fixed at a distance from a bottom of said sump and covers at least a majority of a projected surface of the sump.

6. An oil cooler for cooling lubricant oil in an internal combustion engine comprising:

a cooling element having at least one channel with an inlet and outlet arranged to flow coolant medium, said inlet and said outlet further comprising connections on an outside of the sump for connection to an engine cooling system, and wherein the cooling element is disposed in a space containing lubricating oil, wherein the cooling element is arranged in an engine sump, wherein the cooling element is substantially flat and has a plurality of longitudinal channels, the longitudinal channels being in fluid communication with each other and with the inlet and the outlet, said cooling element further comprising a substantially rectangular, extruded and flat aluminum profile with coolant channels over at least a majority thereof and end pieces fixed to the short sides of the aluminum profile, the end pieces having channels which connect the coolant channels with each other and with the inlet and the outlet, wherein said extruded aluminum profile is made with an oil channel open at both ends, one end of which is disposed to be joined to a suction tube, which extends down into the sump, and the other end of which being arranged to be connected to a suction conduit to an oil pump.

7. The oil cooler as recited in claim 6, wherein said cooling element is elongate and has a plurality of parallel channels extending in a longitudinal direction of said cooling element.

8. The oil cooler as recited in claim 6, wherein said cooling element is fixed at a distance from a bottom of said sump and covers at least a majority of a projected surface of the sump.

9. The oil cooler as recited in claim 6, wherein one end of the aluminum profile has an inlet pipe and an outlet pipe, each of which are arranged to exit through openings in the sump and to be connected to the engine coolant system, and a suction tube joined to the oil channel and which is arranged to be connected to the suction side of the oil pump.

10. The oil cooler as recited in claim 6, wherein one short side of the aluminum profile is joined to two cast end pieces, one of which is cast in one piece with one of said inlet and outlet tubes, the other being cast in one piece with the other of said inlet and outlet tubes and with said suction tubes connected to the oil channel.

* * * * *